US005866989A

United States Patent [19]

Hendrix

[11] Patent Number: 5,866,989

[45] Date of Patent: Feb. 2, 1999

[54] CIRCUIT ARRANGEMENT FOR OPERATING A DISCHARGE LAMP

[75] Inventor: Machiel A. M. Hendrix, Eindhoven, Netherlands

[73] Assignee: U.S. Philips Corporation, New York, N.Y.

[21] Appl. No.: 888,901

[22] Filed: Jul. 7, 1997

[30] Foreign Application Priority Data

Sep. 11, 1996 [EP] European Pat. Off. ..... 96202534

[51] Int. Cl.[6] ..... H05B 37/00

[52] U.S. Cl. ..... 315/209 R; 315/247; 315/DIG. 5

[58] Field of Search ..... 315/209 R, 224, 315/239, 219, DIG. 5, 272, 187, 352, 247

[56] References Cited

U.S. PATENT DOCUMENTS 5,134,344 7/1992 Vos et al. ..... 315/239
5,387,847 2/1995 Wood ..... 315/209

*Primary Examiner*—Don Wong
*Assistant Examiner*—David H. Vu
*Attorney, Agent, or Firm*—Bernard Franzblau

[57] ABSTRACT

A circuit arrangement for operating a discharge lamp. Input terminals are coupled to the poles of a supply voltage source which delivers a low frequency supply voltage. A rectifier is coupled to the input terminals for rectifying the low frequency supply voltage. A branch interconnects output terminals of the rectifier and includes a series arrangement of a first diode, a second diode, and a third diode. The first and second diodes are shunted by a first capacitor. The second and third diodes are shunted by a second capacitor. A resistor passes current during lamp operation with which the first and second capacitors are charged. Lamp current is generated based on the voltages across the first and second capacitors. The resistor is placed in a branch which passes a low frequency alternating current during lamp operation and which connects an input terminal to an input of the rectifier. The circuit arrangement has a high power factor. Radio frequency interference generated in producing the lamp current is effectively suppressed.

8 Claims, 1 Drawing Sheet

CIRCUIT ARRANGEMENT FOR OPERATING A DISCHARGE LAMP

BACKGROUND OF THE INVENTION

The invention relates to a circuit arrangement for operating a discharge lamp, provided with

- input terminals for coupling to the poles of a supply voltage source which delivers a low-frequency supply voltage,
- rectifying means provided with inputs coupled to the input terminals for rectifying the low-frequency supply voltage, and provided with output terminals,
- a branch D which interconnects the output terminals and which comprises a series arrangement of first unidirectional means D1, second unidirectional means D2, and third unidirectional means D3, the first and the second unidirectional means being shunted by first capacitive means C1, and the second and the third unidirectional means being shunted by second capacitive means C2,
- an ohmic resistor R which passes a current during lamp operation with which the first and the second capacitive means are charged,
- means M for generating a lamp current from the voltages present across the first and the second capacitive means.

Such a circuit arrangement is known from U.S. Pat. No. 5,387,847. The branch D and the first and the second capacitive means form an alternative to the use of a single buffer capacitance between the output terminals. Since the first and the second capacitive means are charged in series and discharged in parallel, the circuit arrangement has a higher power factor than if it contained a single buffer capacitance between the output terminals. The power factor of the circuit arrangement is further improved by the presence of the ohmic resistor R which limits the amplitude of the current with which the first and the second capacitive means are charged. A power factor higher than 0.95 can be obtained through a suitable choice of the components of the circuit arrangement. The circuit arrangement can be used in a wide range thanks to this high power factor value. For example, if the discharge lamp is a low-pressure mercury discharge lamp, the lamp current is often a high-frequency alternating current, and the means M often comprise one or several switching elements which are rendered conducting and non-conducting which high frequency during lamp operation. A certain amount of radio frequency interference (RFI) is generated thereby, flowing also into the supply mains while the rectifying means are in the conducting state. The first and the second capacitive means act as a filter via the second unidirectional means D2 whereby the amount of RFI is reduced. In the known circuit arrangement, however, the ohmic resistor R is placed in the branch D between the first and the third unidirectional means. The ohmic resistor does limit the amplitude of the current with which the first and the second capacitive means are charged in this position, but the filtering action of these capacitive means is at the same time strongly suppressed, so that the use of the known circuit arrangement generates a comparatively large amount of RFI in the supply mains.

SUMMARY OF THE INVENTION

The invention has for its object to provide a circuit arrangement with a comparatively high power factor, while at the same time the amount of RFI generated in the supply mains during operation is comparatively small.

According to the invention, a circuit arrangement as described in the opening paragraph is for this purpose characterized in that the ohmic resistor R forms part of a branch I which passes a low-frequency alternating current during lamp operation and which connects an input terminal to an input of the rectifying means.

The current drawn from the supply mains during lamp operation is the current with which the first and the second capacitive means are charged. This current flows through branch I, and accordingly through the ohmic resistor R, so that the amplitude of this current is limited by the ohmic resistor R. The amount of RFI transferred into the supply mains during the period in which the rectifying means are conducting is also limited by the ohmic resistor R. At the same time, the output terminals of the rectifying means are interconnected by a series arrangement which does include the first capacitive means C1, the second unidirectional means D2, and the second capacitive means C2, but not the ohmic resistor R. The absence of the ohmic resistor R in this series arrangement makes the impedance of the series arrangement comparatively low, so that this series arrangement has a satisfactory filtering action.

The first, second, and third unidirectional means may be realized in a simple and inexpensive manner by means of diodes.

The rectifying means may similarly be realized in a comparatively simple and inexpensive manner by means of a diode bridge.

Good results were obtained with circuit arrangements in which the capacitance of the first capacitive means C1 is equal to the capacitance of the second capacitive means C2.

It is often desirable to place a fusistor at the input of the circuit arrangement for breaking the connection between the circuit arrangement and the supply mains if the circuit arrangement draws an excessive current from the supply mains owing to a defect. Since such a fusistor is an ohmic impedance, it is possible to combine the function of the ohmic resistor R and of the fusistor at least in part in that the ohmic resistor R is partly formed by a fusistor.

BRIEF DESCRIPTION OF THE DRAWINGS

An embodiment of a circuit arrangement according to the invention will be explained in more detail with reference to a drawing, in which.

DETAILED DESCRIPTION OF THE PREFERRED EMBODIMENT

Figure 1:
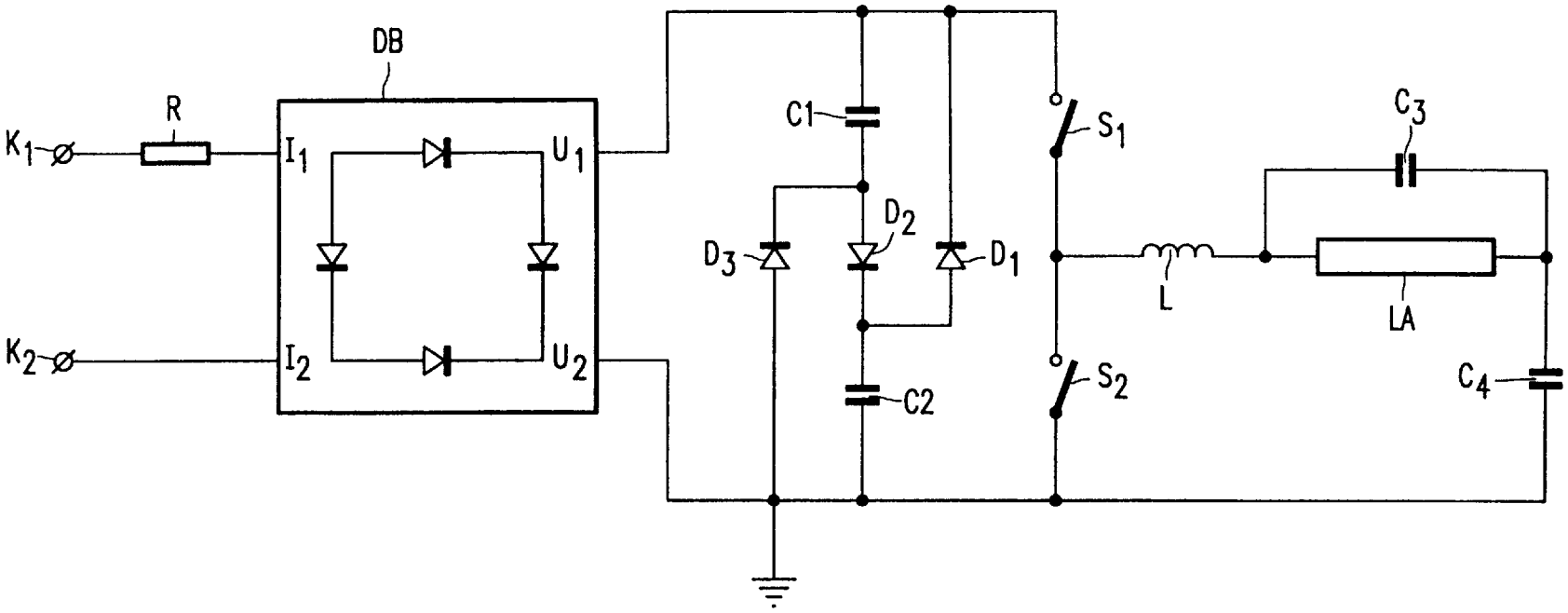
FIG. 1 is a diagram of an embodiment of a circuit arrangement according to the invention.

In FIG. 1, K1 and K2 are input terminals for coupling to the poles of a supply voltage source which delivers a low-frequency supply voltage. This low-frequency supply voltage may be, for example, a sinusoidal AC voltage with a frequency of 50 Hz. Input terminal K1 is connected to a first input I1 of rectifying means, which are formed by a diode bridge DB, via an ohmic resistor R. The ohmic resistor R in this embodiment forms branch I. Input terminal K2 is connected to a second input 12 of the diode bridge DB. U1 and U2 are output terminals of the diode bridge DB. These output terminals are interconnected by a series arrangement of diodes D1, D2, and D3 which in this embodiment form first, second, and third unidirectional means, respectively. Diodes D1, D2, and D3 together form branch D. Diodes D1 and D2 are shunted by capacitor C1 which in this embodiment forms first capacitive means C1. Diodes D2 and D3 are shunted by capacitor C2 which in this embodiment forms second capacitive means C2. Switching elements S1 and S2, coil L, and capacitors C3 and C4, together with means (not shown) for rendering the switching elements S1 and S2 conducting and non-conducting with high frequency, form means M for generating a lamp current from the voltages present across capacitor C1 and capacitor C2. Output terminals U1 and U2 are interconnected by a series arrangement of switching element S1 and switching element S2. A first main electrode of switching element S2 is connected to a second main electrode of switching element S2 by means of a series circuit of coil L, capacitor C3, and capacitor C4. Capacitor C3 is shunted by a discharge lamp La, which is a low-pressure mercury discharge lamp.

The operation of the embodiment shown in FIG. 1 is as follows.

When the input terminals K1 and K2 are coupled to the poles of a supply voltage source which delivers a low-frequency sinusoidal supply voltage, the capacitors C1 and C2 are charged in every half cycle of the supply voltage by means of a current which flows through the ohmic resistor R, diode bridge DB, capacitor C1, diode D2, and capacitor C2. Since capacitors C1 and C2 act as buffer capacitors, a voltage is continually present across both capacitors during stationary operation of the circuit arrangement, so that the current with which the capacitors C1 and C2 are charged flows during a short time interval only of each half cycle. The amplitude of the supply voltage is a maximum or substantially a maximum during this time interval. The fact that the capacitors C1 and C2 are charged in series limits the amplitude of the current. The amplitude of the current with which capacitor C1 and capacitor C2 are charged is also limited by the ohmic resistor R. Limitation of the amplitude of the current with which capacitor C1 and capacitor C2 are charged leads to a comparatively high value of the power factor. Capacitor C1 is discharged by the means M via diode D3 during stationary operation, and capacitor C2 is discharged by the means M via diode D1 during stationary operation. The switching elements S1 and S2 are rendered conducting and non-conducting alternately with high frequency during stationary operation. High frequency is here understood to be a frequency of the order of 10 kHz (often this frequency is taken to be higher than 20 kHz). As a result of this, a high-frequency current flows through the low-pressure mercury discharge lamp La. The high-frequency alternation between conduction and non-conduction of switching elements S1 and S2, however, also causes a certain amount of RFI which flows towards the supply mains while the diode bridge DB is in the conducting state. In the circuit arrangement shown in FIG. 1, however, the RFI generated by the means M is effectively suppressed by capacitors C1 and C2, together forming a filter, via diode D2. A transfer of the RFI into the supply mains is also counteracted by the presence of ohmic resistor R. The power factor of the circuit arrangement is thus comparatively high while at the same time the RFI generated by the means M is effectively.

It will thus be seen that the objects set forth above and those made apparent from the preceding description are efficiently attained, and since certain changes can be made in the above construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

I claim:

1. A circuit arrangement for operating a discharge lamp, comprising:

input terminals for coupling to the poles of a supply voltage source which delivers a low-frequency supply voltage, rectifying means provided with inputs coupled to the input terminals for rectifying the low-frequency supply voltage, and provided with output terminals, a branch which interconnects the output terminals and which comprises a series arrangement of first unidirectional means, second unidirectional means, and third unidirectional means, the first and the second unidirectional means being shunted by first capacitive means, and the second and the third unidirectional means being shunted by second capacitive means, an ohmic resistor which passes a current during lamp operation with which the first and the second capacitive means are charged, and means for generating a lamp current from the voltages present across the first and the second capacitive means, characterized in that the ohmic resistor forms part of a branch which passes a low-frequency alternating current during lamp operation and which connects an input terminal to an input of the rectifying means.

2. A circuit arrangement as claimed in claim 1, wherein the first, second, and third unidirectional means each comprise a diode.

3. A circuit arrangement as claimed in claim 2, wherein the rectifying means comprise a diode bridge.

4. A circuit arrangement as claimed in claim 3, wherein the capacitance value of the first capacitive means is equal to the capacitance value of the second capacitive means.

5. A circuit arrangement as claimed in claim 2, wherein the capacitance value of the first capacitive means is equal to the capacitance value of the second capacitive means.

6. A circuit arrangement as claimed in claim 1, wherein the rectifying means comprise a diode bridge.

7. A circuit arrangement as claimed in claim 6, wherein the capacitance value of the first capacitive means is equal to the capacitance value of the second capacitive means.

8. A circuit arrangement as claimed in claim 1, wherein the capacitance value of the first capacitive means is equal to the capacitance value of the second capacitive means.

* * * * *